US005337580A

United States Patent [19]

Zhao et al.

[11] Patent Number: 5,337,580

[45] Date of Patent: Aug. 16, 1994

[54] ROOM AIR CONDITIONER

[75] Inventors: Guoquan Zhao; Yehia M. Amr, both of Manlius; Peter R. Bushnell, Cazenovia; Alan S. Drucker, Dewitt; Eric J. Nash, Manlius, all of N.Y.

[73] Assignee: Carrier Corporation, Syracuse, N.Y.

[21] Appl. No.: 993,880

[22] Filed: Dec. 23, 1992

[51] Int. Cl.[5] ..... F25B 47/00

[52] U.S. Cl. ..... 62/262; 62/280; 454/201; 165/122

[58] Field of Search ..... 62/262, 280; 454/201; 165/122

[56] References Cited

U.S. PATENT DOCUMENTS

| | | | |
|---|---|---|---|
| 670,998 | 4/1901 | Patterson | 239/223 |
| 2,667,765 | 2/1954 | Harris et al. | 62/140 |
| 2,736,176 | 2/1956 | Carlton | 62/129 |
| 2,760,354 | 8/1956 | Brady et al. | 62/129 |
| 3,898,865 | 8/1975 | Stewart et al. | 62/262 X |
| 4,370,863 | 2/1983 | Fisher | 62/89 |

FOREIGN PATENT DOCUMENTS

| | | | |
|---|---|---|---|
| 0424614 | 5/1991 | European Pat. Off. | 165/122 |

*Primary Examiner*—William E. Wayner

[57] ABSTRACT

A low profile room air conditioner. The low profile is achieved in part by the arrangement of components in its outside section. The fan that moves air through the outside section is of the axial flow type mounted so that its axis of rotation is substantially perpendicular to the base of the enclosure and so that the fan draws air into the outside section through the top of the enclosure. Air discharges from the outside section through an air discharge on a side of the enclosure. Louvers at the air discharge direct the air exiting the enclosure away from the air inlet. A slinger directs droplets of condensate drained from the inside refrigerant-to-air heat exchanger into the air flowing through the outside section. The air carries the condensate on to the outside refrigerant-to-air heat exchanger where it evaporates. The air flow carries the resultant water vapor out of the outside section.

2 Claims, 2 Drawing Sheets

ROOM AIR CONDITIONER

BACKGROUND OF THE INVENTION

This invention relates generally to vapor compression air conditioning systems. More particularly, the invention relates to an arrangement and configuration of the components in an air conditioner of the type commonly mounted in the window of a room.

The fundamental principles of the operation and construction of vapor compression air conditioning systems are well known in the art. In the typical window room air conditioner, all the components of the system are contained in a single enclosure. The enclosure has an inside section containing the inside refrigerant-to-air heat exchanger and an inside fan for circulating air from the room to be cooled or heated over that heat exchanger. The enclosure also has an outside section. The enclosure is configured so that air cannot pass between the inside section and the outside section. The outside section of the enclosure contains the outside refrigerant-to-air heat exchanger, an outside fan for circulating outside air over that heat exchanger and, usually, the system compressor. Other system components, such as an expansion device, controls and the like are located in either one section or the other as appropriate or desirable. The air conditioner is mounted in a window or other aperture in a wall of a room so that the inside section is inside the room and the outside section extends into the space outside the room. If the air conditioner is designed for cooling only, the outside refrigerant-to-air heat exchanger functions only as a condenser and the inside refrigerant-to-air heat exchanger operates only as an evaporator. If the air conditioner is designed for both heating and cooling, i.e. as a heat pump, a given heat exchanger may function as either a condenser or an evaporator depending on system operating mode.

Designers and builders of room air conditioners are constantly striving to increase the capacity and efficiency and reduce the size and cost of their products. One benefit of reducing the size, particularly the height, of a room air conditioner intended to be mounted in a window is that a lower profile machine occupies less of the total area of the window aperture and thus leaves more of that area available for light transmission and viewing.

Room air conditioners are commonly configured so that both the outside and the inside fans are mounted on a single shaft driven by a single motor. The motor shaft is parallel to the enclosure base and extends into both the inside and outside sections. This configuration has cost benefits but, because an axial flow fan is the most effective type of fan for use in the outside section, imposes a practical lower limit on the enclosure height of an air conditioner of a given configuration and capacity. This limit arises because of the need to provide a given minimum air flow across the outside refrigerant-to-air heat exchanger. Because of the fan motor and shaft configuration, the plane of rotation of the outside fan must be perpendicular to the enclosure base. And there is a practical upper limit on fan speed because of physical limitations and noise considerations. All of these factors dictate that the outside fan have a minimum diameter to provide the requisite air flow and that therefore the height of the enclosure be sufficient to enclose this minimum diameter.

When ambient conditions require that an air conditioning system operate in the cooling mode, the warm ambient air is frequently also humid. As the air to be cooled passes over the inside refrigerant-to-air heat exchanger, the air temperature is lowered to below the dewpoint, moisture in the air condenses as water on the heat exchanger and the condensate water drains from the heat exchanger. Some means must be provided to dispose of the condensate water. One means of disposal is to provide a condensate drain line out of the air conditioner. That approach is simple and direct but can also be inconvenient, complicated and unsightly, particularly in a small room air conditioner. Another disposal means is to provide a drainage path from the point of condensate collection under the inside refrigerant-to-air heat exchanger to a point in the outside section of the air conditioner where some means is provided to pick up and sling the condensate water on to the outside refrigerant-to-air heat exchanger. As that heat exchanger is operating as a condenser when in the cooling mode, it is warm and water impinging on it will evaporate and be carried away as vapor in the air stream passing through the heat exchanger. In addition to eliminating the need for an external condensate drain, this method of disposing of condensate also contributes to system efficiency, as the transfer of the heat of vaporization to the water contributes to the cooling of the refrigerant in the heat exchanger. In a heat pump type air conditioner, providing means for disposal of condensate on the outside heat exchanger by this means is rarely necessary.

SUMMARY OF THE INVENTION

The present invention is a vapor compression air conditioning system of the type usually mounted in the window of a room. The arrangement and configuration of certain components mounted in the outside section of the system enclosure allow the vertical dimension of the enclosure to be minimized, so that the unit occupies a minimum of the total of the window area, particularly in the vertical dimension. The amount of window area available for light transmission and viewing is thus increased over that which would exist if an air conditioner of the usual configuration were installed in the window.

The outside section fan is of the axial flow type and has an axis of rotation that is generally perpendicular and is directly driven by a fan motor. The fan draws air into the outside section through an opening in the top of the outside section. Air exits the outside section through an opening in the side of that section. The outside refrigerant-to--air heat exchanger is located so that air from the fan discharge must pass through the heat exchanger before exiting the outside section. Louvers at the outside section air exit opening direct the discharge air downward so that the discharge is not recycled into the enclosure by the outside fan. Condensate water draining from the inside refrigerant-to-air heat exchanger is directed to a condensate collector in the bottom of the outside section of the enclosure. A condensate slinger, driven by the same motor that drives the outside fan, extends into the condensate collector and causes water from the collector to be introduced into the stream of air entering the outside heat exchanger.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
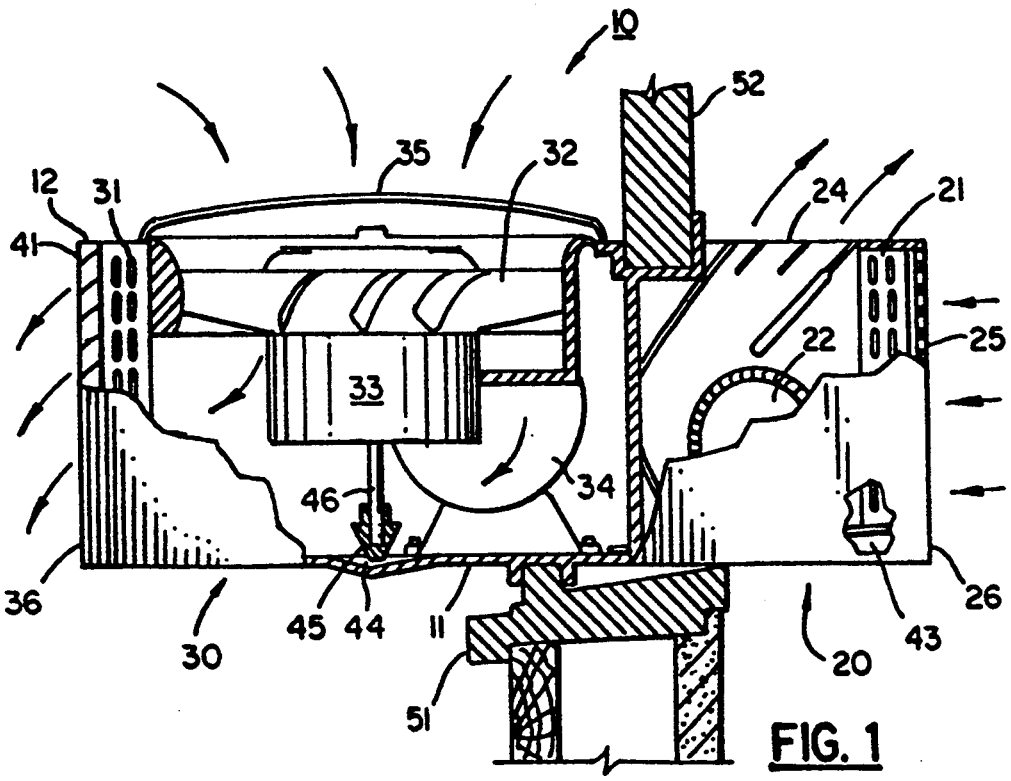
FIG. 1 is a side elevation view, partially broken away, of an air conditioning system embodying the present invention.
Figure 2:
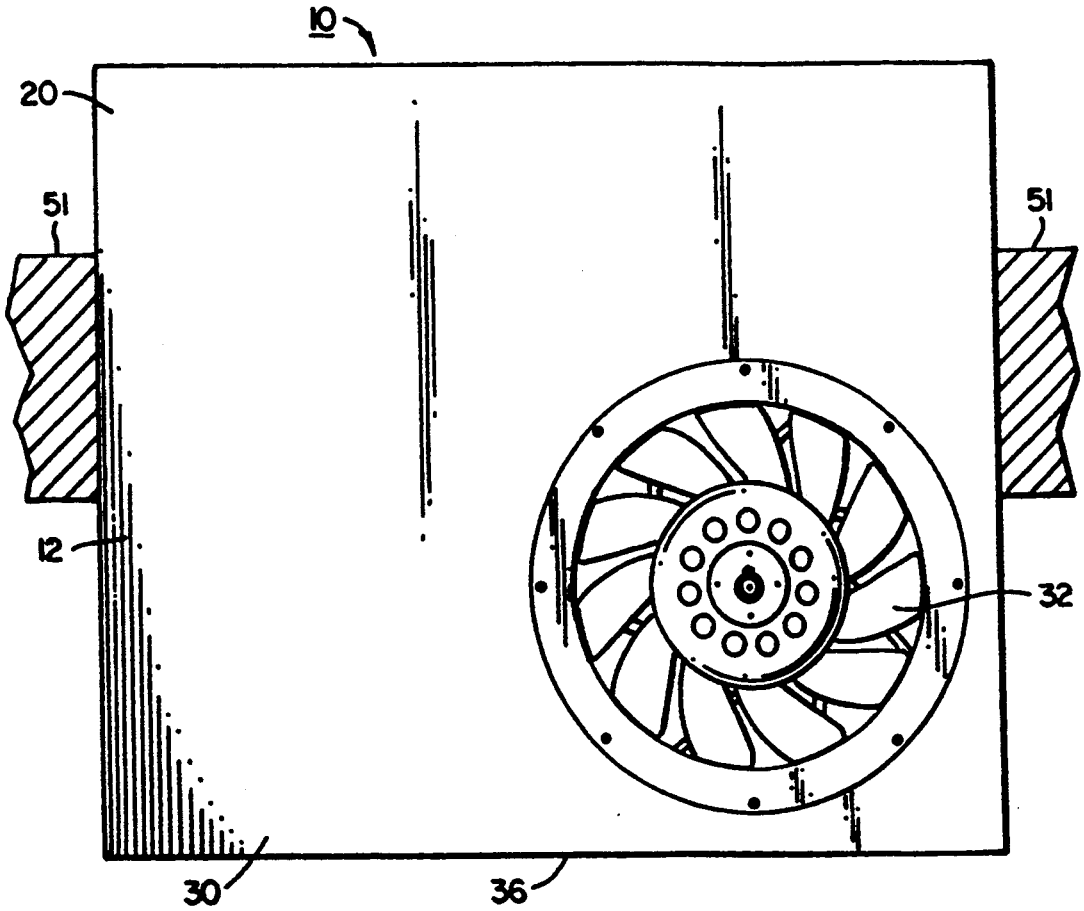
FIG. 2 is a top plan view, partially broken away, of an air conditioning system embodying the present invention.

FIG. 1, in a side elevation view, partially broken away, depicts an air conditioning system embodying the present invention. The figure shows air conditioner 10 mounted in a window by resting on sill 51 and held in place by sash 52. The enclosure of air conditioner 10 has base 11 and top 12.

Inside section 20 of the system extends into the space to be conditioned. Section 20 contains inside refrigerant-to-air heat exchanger 21 and inside fan 22. Air from the space served by the system enter inside section 20 through inside air inlet 25, passes through heat exchanger 21, where the air is either heated or cooled, and fan 22 before exiting inside section 20 through inside air discharge 23.

Outside section 30 of the system is outside the space whose air is to be conditioned. Section 30 contains outside refrigerant-to-air heat exchanger 31, outside fan 32, outside fan motor 33 and compressor 34. Outside air enters outside section 30 through air inlet 35, then passes through fan 32 and outside refrigerant-to-air heat exchanger 31 before exiting outside section 31 through discharge louvers 41. Louvers 41 are configured so as to direct the warmed exiting air downward and away from the air intake so that exiting air will not be "short cycled" through air inlet 35 back into the outside section.

Coaxial with fan 32 and also directly driven by motor 33 through shaft extension 46 is condensate slinger 45. Slinger 45 extends into condensate drain collector 44. There is a path 43 for condensate water that drains off inside heat exchanger 21 to flow from a location under heat exchanger 21 to collector 44. Collector 44 and path 43 need be nothing more than suitable depressions formed in enclosure base 11.

Figure 3:
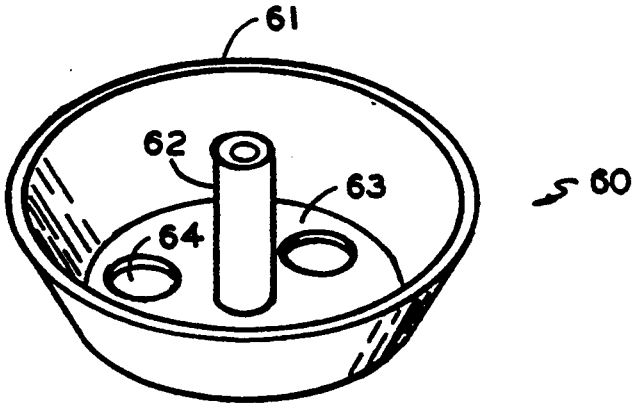
FIG. 3 is an isometric view of a condensate slinger that may be used in the present invention.

FIG. 3 depicts a simple but effective slinger for use in an application such as the present invention. Slinger 60 is of the cone pump type. Slinger 60 has the overall shape of a truncated cone, the same general shape that one finds in common types of disposable drinking cups. Sloping conical wall 61 has an upper end that defines an open top and extends from an open top to a lower end closed by bottom 63. Shaft socket 62 is affixed to the center of bottom 63 and rises along the axis of the cone to provide means for attaching slinger 60 to a drive shaft. There are one or more holes 64 in bottom 63. When slinger 60 extends into a reservoir of liquid so that just bottom 63 is immersed, the liquid flows into the interior of the slinger through holes 64. If the slinger rotates at sufficient speed, centrifugal force causes the liquid to be drawn away from the axis of the slinger and up the interior of sloping conical wall 61. When the liquid reaches the top of wall 61, it continues to flow upward and outward away from slinger 60 .

During operation of air conditioning system 10 in the cooling mode, condensate water that drains off heat exchanger 21 flows through path 43 and collects in collector 44. When the level of water in collector 44 reaches a predetermined level, the water comes into contact with slinger 46. Slinger 46, preferably of the type depicted at reference number 60 in FIG. 3, lifts the water and scatters it into the air stream flowing from fan 32 to heat exchanger 31. The air carries the water in to heat exchanger 31 where, because of the elevated temperature of the heat exchanger, the water evaporates. The resulting water vapor is then carried out of air conditioning system be with the exiting air. The condensate formed in inside heat exchanger 21 is thus disposed of without the need of drains or other means of condensate disposal. Depositing the water on to outside heat exchanger 31 improves the overall operating efficiency of system 10 as the transfer of heat necessary to vaporize the condensate serves to cool the hot refrigerant flowing through outside heat exchanger 31. System 10 will function satisfactorily even if it is of the reversible or heat pump type, for disposal of condensate formed on outside heat exchanger 31 by slinger would not be required. Some other means of condensate disposal, usually by defrosting, may, however, be necessary.

We claim:

1. An improved room air conditioner (10), said air conditioner having an enclosure having a base (11) and a top (12), an inside section (20) in said enclosure, an outside section (30) in said enclosure, an inside refrigerant-to-air heat exchanger (21) in said inside section, an outside refrigerant-to-air heat exchanger (31) in said outside section, a fan (32), directly driven by a fan motor (33), both fan and motor being in said outside section, an outside air inlet (35) into said outside section and an air discharge to outside (41) from said outside section, in which the improvement comprises:

said fan being of the axial flow type and having an axis of rotation that is substantially perpendicular to said enclosure base;

said outside air inlet being located in said enclosure top;

said air discharge to outside being located in a side of said enclosure;

an air flow path through said outside section so that air enters said outside section through outside air inlet and then flows through said fan, then flows through said outside refrigerant-to-air heat exchanger then exits said outside section through said air discharge to outside;

discharge louvers arranged in said air flow path at said air discharge to outside so that air exiting said air discharge to outside is directed away from said outside air inlet;

a condensate collector (44) in said outside section; and slinger means (45) extending into said condensate collector and driven by said motor.

2. The room air conditioner of claim 1 in which said slinger means is of the cone pump type (60) comprising:

a truncated conical cup having an upper and lower end, a sloping conical wall (61) extending from said upper to said lower end and surrounding an interior volume, and a bottom (63) closing said lower end and having passages (64) to allow a fluid to flow into said interior volume; and means (62) fixed to said bottom for connecting said slinger means to a drive shaft of said motor.

* * * * *